US008062822B2

(12) United States Patent
Inoue et al.

(10) Patent No.: US 8,062,822 B2
(45) Date of Patent: Nov. 22, 2011

(54) CARRIER FOR ELECTROSTATIC LATENT IMAGE DEVELOPMENT AND ELECTROSTATIC LATENT IMAGE DEVELOPER

(75) Inventors: Satoshi Inoue, Minamiashigara (JP); Masahiro Takagi, Minamiashigara (JP); Koutarou Yoshihara, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 905 days.

(21) Appl. No.: 11/295,502

(22) Filed: Dec. 7, 2005

(65) Prior Publication Data

US 2007/0048650 A1 Mar. 1, 2007

(30) Foreign Application Priority Data

Aug. 26, 2005 (JP) ..... 2005-246623

(51) Int. Cl.
*G03G 9/113* (2006.01)

(52) U.S. Cl. ..... 430/111.33; 430/111.1; 430/111.35; 430/111.41

(58) Field of Classification Search ..... 430/111.1, 430/111.33, 111.35, 111.41
See application file for complete search history.

(56) References Cited

U.S. PATENT DOCUMENTS

| | | | | |
|---|---|---|---|---|
| 5,821,023 | A * | 10/1998 | Shibuya et al. | 430/108.6 |
| 5,884,129 | A * | 3/1999 | Ichimura et al. | 399/252 |
| 6,004,717 | A * | 12/1999 | Creatura et al. | 430/137.13 |
| 6,617,088 | B2 * | 9/2003 | Iizuka et al. | 430/110.4 |
| 2004/0197693 | A1 | 10/2004 | Ninomiya et al. | |
| 2004/0253529 | A1 * | 12/2004 | Baba et al. | 430/111.35 |
| 2005/0112489 | A1 * | 5/2005 | Fujikawa et al. | 430/111.35 |
| 2005/0164109 | A1 * | 7/2005 | Iizuka et al. | 430/108.1 |
| 2005/0238980 | A1 * | 10/2005 | Yamashita et al. | 430/108.1 |

FOREIGN PATENT DOCUMENTS

| | | |
|---|---|---|
| JP | A 02-135371 | 5/1990 |
| JP | A-6-222619 | 8/1994 |
| JP | A 07-271106 | 10/1995 |
| JP | A 10-039547 | 2/1998 |
| JP | A 10-133480 | 5/1998 |
| JP | A 2003-280284 | 10/2003 |
| JP | A 2004-061730 | 2/2004 |
| JP | A 2004-077568 | 3/2004 |

* cited by examiner

*Primary Examiner* — Mark Huff
*Assistant Examiner* — Rachel Zhang
(74) *Attorney, Agent, or Firm* — Oliff & Berridge, PLC

(57) ABSTRACT

An electrostatic latent image developing carrier is provided which comprises a core particle and a resin coating layer containing conductive particles dispersed therein, the carrier having a volume average particle diameter of 25 to 60 μm and an average degree of circularity of 0.975 or more, wherein the core particle has a BET specific surface area of 0.1 to 0.3 $m^2/g$ and an internal void ratio of 10% or less.

16 Claims, No Drawings

CARRIER FOR ELECTROSTATIC LATENT IMAGE DEVELOPMENT AND ELECTROSTATIC LATENT IMAGE DEVELOPER

CROSS-REFERENCE TO RELATED APPLICATION

This application claims priority under 35 USC 119 from Japanese patent Application No. 2005-246623, the disclosure of which is incorporated by reference herein.

BACKGROUND OF THE INVENTION

1. Field of the Invention

The present invention relates to an electrostatic latent image developer to be used in an electrophotographic method and electrostatic recording, and to an electrostatic latent image developing carrier to be used in the developer.

2. Description of the Related Art

In an electrophotographic method, an electrostatic latent image is formed on a latent image holding member (photoreceptor) by charging and exposure steps, and developed by toner. The developed image is transferred to an image receiving member and fixed by heating or the like to obtain an image. Developers usable in such an electrophotographic method may be roughly classified into one-component developers and two-component developers. A one-component developer is a toner itself containing a colorant dispersed in a binder resin, and a two-component developer comprises such a toner and a carrier. The two-component developer has high controllability because the carrier has the functions of stirring, transferring and charging the developer; that is the functions as a developer is separated. For the above reasons, the two-component developer is widely used at present.

In recent years, digitalization has been adopted as a measure to achieve high image quality. This digitalization enabled high-speed processing of a complicated image. Moreover, a laser beam is used to form an electrostatic latent image on a latent image holding member. The development of exposure technologies using a small laser beam has increased the resolution of an electrostatic latent image. Image processing technologies like this permit the application of electrophotographic method to light printing. Moreover, there has been a demand for developments of high-speed and high-resolution electrophotographic devices in recent years. In particular, regarding full-color image quality, high-quality image close to that of high-class printing or silver salt photography is desired. Therefore, the retention of the charge of the developer is important to ensure the visualization of latent images with higher resolution for a long period of time. Namely, there are needs for further improvement of the charge retention property of the carrier having a charging function.

The resistance of the carrier is also an important factor to achieve high quality image. In order to improve the image quality, the carriers used in current digital devices have been made smaller and their electric resistance values have also been reduced. These small-sized carriers make it possible to reproduce a precise image and to provide stable charges even to small-sized toners. Also, the reduction in resistance improves reproduction of a solid image. Such carriers are particularly preferable for the formation of full-color high-density images.

If a carrier having high resistance is used, the quality a half-tone image is deteriorated. For example, image defects may occur in which white portion is generated at the boundary between a black-haired person image and a pale background. This is the reason why a carrier having a low resistance has been selected in high image quality full color machines so as to fully utilize the image characteristics of the machines (see, for example, Japanese Patent Application Laid-Open (JP-A) Nos. 10-39547, 10-133480, and 2003-280284). However, on the other hand, there are many techniques in which the resistance of carriers is increased so as to limit the transfer of a carrier (see, for example, JP-A No. 7-271106).

Although the use of a carrier having a low resistance remarkably improves image qualities, the transfer of the carrier to an image easily occurs.

The carrier transfer is roughly divided into three categories: (i) carrier transfer onto the entire surface of the output image, (ii) carrier transfer onto the background, and (iii) carrier transfer onto the image. The main cause of the carrier transfer onto the entire surface is low magnetic force. The carrier transfer onto the background is usually caused by high resistance and a large particle diameter; specifically, a carrier is oppositely charged by a toner, and develops uncharged areas. The carrier transfer onto the image is mainly caused by low resistance; the toner charge or developing charge is injected into the carrier, and the carrier, together with the toner, develops the charged area.

Therefore, when the resistance of the carrier is decreased, image quality is improved but carrier transfer to the image is caused by the injection of charge. Therefore, the carrier design has aimed to achieve a resistance within such a range to cause no carrier transfer and to enable formation of high-quality images.

Carriers are roughly classified into (i) dispersion-type carriers obtained by dispersing magnetite in resins and (ii) resin-coated carriers each obtained by coating the surface of a core such as ferrite, magnetite or iron powder with a resin. The developer containing a carrier of the former class has reduced fluidity and has inferior conveyability to developers containing carriers of the latter class, partly owing to the reduction in specific gravity. Also, because the a carrier of the former class has a lower magnetic force per carrier particle than a developer of the latter class, the carrier of the former class is disadvantageous in carrier transfer. Therefore, various studies have been made on resin-coated carriers. For example, a carrier has been proposed which has a low-resistance layer provided on the surface of a core and a high-resistance layer thereon (see, for example, JP-A No. 2004-61730). Although this carrier is surely more resistant to the abrasion of the coated layer (resin coating layer) over time, but has no effect on the prevention of peeling of a part with low adhesion to the core. As a result, the core is exposed to be injected with charge, thereby generating carrier transfer. Also, an attempt is made to improve the adhesion to the core by defining the diameter of pores on the surface of the core (see, for example, JP-A No. 2-135371). However, when the shape of the core is complex as in the above method, the core easily cracks or chips from the deformed part. Even if the core is coated with a resin, the resulting carrier easily cracks, or the core cracks during the process of producing the carrier. Also, another carrier has been proposed which has a porous core (see, for example, JP-A No. 2004-77568). However, the core itself has insufficient strength and the coating layer does not penetrate to the inside. Therefore, the carrier is not resistant to cracking, whereby the carrier is transferred by the injection of charge.

SUMMARY OF THE INVENTION

The present invention has been made in view of the aforementioned prior art problem.

The invention provides a carrier for electrostatic latent image development. The carrier comprises a core particle and a resin coating layer coated on the core particle. The resin coating layer comprises conductive particles dispersed therein. The carrier has a volume average particle diameter of 25 to 60 μm and an average degree of circularity of 0.975 or more. The core particle has a BET specific surface area of 0.1 to 0.3 $m^2/g$ and an internal void ratio of 10% or less.

The core particle may comprise $Fe_2O_3$ and oxide(s) of one or more elements selected from Li, Mg, Ca, Mn, Ni, Cu, Zn, and Sr, and a ratio of a content of the oxide(s) of one or more elements selected from Li, Mg, Ca, Mn, Ni, Cu, Zn and Sr to a content of $Fe_2O_3$ may be 5 to 50% by weight.

The volume electric resistance of the electrostatic latent image developing carrier may be $1\times10^9$ Ω·cm to $5\times10^{16}$ Ω·cm. The conductive particles may have a saturation magnetization at 3000 oersteds of 50 emu/g or more. The conductive particles may have a volume electric resistance of $10^{10}$ Ω·cm or less. The resin coating layer may comprise resin particles. The resin particles may be a thermosetting resin and/or a thermoplastic resin. The resin particles may have a volume average particle diameter of 0.1 to 1.5 μm. The content of the resin particles in the resin coating layer may be 2 to 20% by weight.

The invention further provides an electrostatic latent image developer comprising a toner and a carrier, wherein the carrier is the above carrier for electrostatic latent image development.

The toner may have a volume average particle diameter of 2 to 12 μm. The toner may comprise a releasing agent. The toner may comprise an inorganic oxide having a volume average particle diameter of 20 to 300 nm. The shape factor SF1 of the toner may be 140 or less.

DETAILED DESCRIPTION OF THE INVENTION

As described above, there are strong needs for development of smaller-sized less expensive electrophotographic machines that enables formation of images with higher quality. In order to obtain images with high quality, it is necessary for a developer to retain charging property and electric resistance for a long period of time. In order to retain the electric resistance of the developer, cracks and chips of the carrier should be suppressed and the peeling of the coated layer (resin coating layer) should also be suppressed. As a result of detailed studies made by the inventors of the invention, it has been found that the cracks and chips of the carrier can be suppressed and the peeling of a coated layer can be suppressed by using a carrier having a resin coating layer containing conductive particles. The carrier has a particle diameter within a specific range and a shape within a specific range. The core of the carrier has a surface structure within a specific range.

Accordingly, the carrier for electrostatic latent image development (hereinafter referred to as "electrostatic latent image developing carrier) comprises a core particle and a resin coating layer coated on the core particle, wherein the resin coating layer comprises conductive particles dispersed therein, the carrier has a volume average particle diameter of 25 to 60 μm and an average degree of circularity of 0.975 or more, and the core particle has a BET specific surface area of 0.1 to 0.3 $m^2/g$ and an internal void ratio of 10% or less.

In the detailed explanations of the invention, the structure of the carrier is first explained and then each component will be described.

(Average Particle Diameter of the Carrier)

When the volume average particle diameter of the carrier exceeds 60 μm, the energy of collision in a developing machine is increased. Therefore, cracking and chipping of the carrier are promoted. Further, since the surface area, which works for providing charge to the toner, is decreased, the ability to provide charge to the toner is deteriorated and, as a result, image quality is degraded. On the other hand, when the volume average particle diameter of the carrier is smaller than 25 μm, the surface area of the carrier is increased excessively. Therefore, not only the fluidity of the carrier itself is reduced to lower the ability to transfer the toner, but also magnetic force per carrier particle is reduced. Therefore, the magnetic restraint of the chain of the magnetic brush is weaker than the developing electric field, whereby the carrier easily transfers to the photoreceptor. The above volume average particle diameter is more preferably 27 to 55 μm, and particularly preferably 30 to 50 μm.

Method of Measuring the Average Particle Diameter of the Carrier

The volume average particle diameter of a carrier is measured using a measuring device (trade name: LS13320, manufactured by Beckman Coulter) according to a laser diffraction scattering method. To describe in detail, a small amount of the carrier is dispersed in an aqueous solution containing a surfactant and the dispersion liquid is injected into LS13320 by a syringe to conduct measurement. During the measurement, the pump speed of LS13320 is set at 80%.

(Average Degree of Circularity of the Carrier)

When the average degree of circularity of the carrier is less than 0.975, chips are generated at convex portions by stirring stress in a developing machine. In the invention, the average degree of circularity of the carrier is preferably 0.985 or more and particularly preferably 0.989 or more.

Method of Measuring Average Degree of Circularity of Carrier

The carrier is dispersed in an aqueous 25% ethylene glycol solution and a measuring device (trade name: FPIA3000, manufactured by CISMEX) is used to measure the degree of circularity in a LPF measuring mode. Particles having a particle diameter less than 10 μm and particles having a particle diameter exceeding 50 μm are omitted in the analysis, and the average degree of circularity is determined from the measured values of 100 particles.

(BET Specific Surface Area of Core Particle)

When the BET specific surface area of the core particle is less than 0.1 $m^2/g$, the irregularities on the surface of the core are so small that the adhesion of the core to the coated layer is weakened, whereby the coated layer peels off. Also, such a small BET specific surface has a disadvantage that cracks of the surface of the core are generated to cause core cracking by stress in the core crushing step, in the resin coating step, or in the developing machine. On the other hand, when the specific surface area exceeds 0.3 $m^2/g$, the core itself becomes porous, so that the strength of the core itself is dropped; therefore the core cracks to produce the clearance between the core and the coated layer in the resin coating step, resulting in peeling of the coated layer. The above BET specific surface area is more preferably 0.13 to 0.27 μm and particularly preferably 0.15 to 0.25 μm.

Method of Measuring BET Specific Surface Area of Core Particle

The BET specific surface area of the core particle is measured by a nitrogen substitution method using a specific surface area measuring device (trade name: SA3100, manufactured by Beckman Coulter) according to the three-point method. Specifically, a core particle sample is injected into a 5 g cell, which is then deaerated at 60° C. for 120 minutes, and then measurement is conducted using a mixed gas of nitrogen and helium (30:70).

(Inside Void Ratio of Core Particle)

Also, when the internal void ratio of the core particle is more than 10%, there is a problem that the strength of the core itself is reduced to cause cracking. The internal void ratio is preferably 5% or less.

Method of Measuring Internal Void Ratio of Core Particle

The carrier is embedded in an epoxy resin and then abraded. An image of the particle on a photograph taken at a magnification of 1000 by using FE-SEM (trade name: S4100, manufactured by Hitachi, Ltd.) is subjected to image analysis using LUZEX III, manufactured by Nireco Corporation, to measure AREA-H (area corresponding to holes) and AREA (area). The internal void ratio can be calculated from the following equation.

Internal void ratio (%)=AREA-H (area corresponding to holes)/AREA(area)

In the following, a method of controlling the average particle diameter and shape (namely, average degree of circularity) of the carrier and the surface structure of the core particles (namely, BET specific surface area and internal void ratio) is described.

The resin coated carrier is manufactured by coating a powder of a metal (such as ferrite, magnetite, iron, cobalt or nickel having ferromagnetism) with a resin. With regard to a method of producing core particles, in the case of ferrite, raw materials are milled and subjected to dispersing treatment to be atomized and homogenized, and then the atomized product is granulated and baked to produce core particles. In some cases, the obtained particles are further subjected to crushing treatment to disunite aggregation.

In the preparation of core particles, not only the composition of the raw materials, but also process conditions are regulated to control the surface structure of the core particles. For example, a rise in baking temperature brings about the growth of the grain boundary, making the surface smooth. However, such a core surface easily cracks, and cracking occurs in the subsequent crushing step, or, even if the core is not broken in the crushing step, cracking often occurs in a resin coating step of the preparation of the carrier or in a developing machine by stress even after the carrier preparation is completed. Also, the adhesion to the coating resin is weakened and therefore, the coated layer tends to peel off. When the baking temperature is dropped, the growth of the grain boundary is limited, whereby surface irregularities are increased. When the baking temperature is extremely low, the core becomes porous. However, such a porous core is weak, so that the core easily cracks. Moreover, since clearance tends to be generated upon coating with the resin, the coated layer easily peels.

Also, regarding the shape of the carrier, the carrier is less likely to crack as the shape of the carrier becomes closer to a sphere. When the raw materials are dispersed nonuniformly in the above process of producing the ferrite core, a core with nonuniform internal structure is produced in the granulation step; therefore the grain boundary becomes nonuniform during the baking, and the nonuniformity affects the shape of the carrier. Also, when the baking temperature in the baking step is not controlled precisely, the growth of grain boundaries becomes nonuniform, and the nonuniformity affects the shape of the carrier. Also in the granulation step, there is an aggregate of two or three particles. The aggregate after baking takes a shape that is far from a sphere. The surface structure of the core particle can be controlled by optimizing these core forming steps.

To state in more detail, the BET specific surface area of the core particle can be controlled by baking temperature and baking time. When the baking temperature is higher and the baking time is longer, the grain boundary of the core grows to make the surface smooth; therefore, the BET specific surface area is decreased. When the baking temperature is lower and the baking time is shorter, on the contrary, the surface of the core becomes irregular and the BET specific surface area is therefore increased.

The internal void ratio of the core particles can be decreased by intensifying the milling of the slurry (for example, elongation of the milling time) because the raw materials are uniformly dispersed. The internal void ratio is decreased by a higher baking temperature and a longer baking time because the internal baking of the core proceeds.

The average particle diameter of the carrier is determined by the average particle diameter of the core particles and the thickness of the resin coating layer. The average particle diameter of the core particles is controlled by controlling the granulating step or classifying (sieving) step. On the other hand, the thickness of the resin coating layer is controlled by the type and amount of the resin and the method of coating the resin on the core.

The average degree of circularity of the carrier is determined by the average degree of circularity of the core particles and the uniformity of the resin coating layer. The average degree of circularity of the core particles is controlled by intensifying the slurry milling step, suppressing the integration of particles (by dropping the baking temperature and/or shortening the baking time) and suppressing cracking by reducing the energy in a crushing step after baking. On the other hand, the uniformity of the resin coating layer is controlled by selecting appropriate resin coating conditions and an appropriate type of resin.

Then, the structural materials of the carrier of the invention will be explained.

(Material for the Core Particle)

The core material may be selected from known materials such as powder of a metal exhibiting ferromagnetism, such as ferrite, magnetite, iron, cobalt or nickel. Ferrite particles having a low specific gravity are preferable from the viewpoint of suppressing the peeling of the carrier coat caused by stress applied in a developing machine and suppressing the toner spent on the surface of the carrier.

As the ferrite, conductive particles containing, as major components, $Fe_2O_3$ and oxide(s) of one or more elements selected from Li, Mg, Ca, Mn, Ni, Cu, Zn and Sr, are preferable and conductive particles containing, as major components, $Fe_2O_3$ and oxide(s) of one or more elements selected from Li, Mg, Mn and Sr, are more preferable, from the viewpoint of achieving the desired magnetic susceptibility of the carrier of the invention. The ratio of the content of the oxide(s) of one or more elements selected from Li, Mg, Ca, Mn, Ni, Cu, Zn and Sr to the content of $Fe_2O_3$ is preferably 5 to 50% by weight, and more preferably 10 to 40% by weight.

(Material for Resin Coating Layer)

Resin

The resin (matrix resin) to be used in the above resin coating layer may be selected from resins usable for forming a coated layer of a carrier in the technical fields concerned. For example, only one charge imparting resin that imparts charging property to the toner may be used, or two or more resins including a low-surface energy material may be used to prevent the toner component from transferring to the carrier.

Examples of the charge imparting resin that imparts negatively charging property to the toner include: amino resins such as urea-formaldehyde resin, melamine resin, benzoguanamine resin, urea resin, polyamide resin and epoxy resin; polyvinyl resins; polyvinylidene resins; acryl resins; polymethylmethacrylate resins; polystyrene resins such as a styrene-acryl copolymer resin; polyacrylonitrile resins; polyvinyl acetate resins; polyvinyl acetate resins; polyvinyl alcohol resins; polyvinylbutyral resins; and cellulose resins such as ethyl cellulose resin. Examples of the charge imparting resin that imparts positively charging property to the toner include: polystyrene resins; halogenated olefin resins such as polyvinyl chloride; polyester resins such as a polyethylene terephthalate resin and polybutylene terephthalate resin; and polycarbonate resins. Examples of the low-surface energy material that prevents the toner component from transferring to the carrier include: polystyrene resins; polyethylene resins; polyvinyl fluoride resins; polyvinylidene fluoride resins; polytrifluoroethylene resins; polyhexafluoropropylene resins; copolymers of vinylidene fluoride and an acryl monomer; copolymers of vinylidene fluoride and vinyl fluoride; fluoroterpolymers such as a terpolymer of tetrafluoroethylene, vinylidene fluoride and a fluorine-free monomer; and silicone resins.

Conductive Particles

Also, the carrier of the invention comprises conductive particles in the resin coating layer. When conductive particles are not contained in the resin coating layer, the electric resistance is determined by the thickness of the resin coating layer. In order to achieve the desired resistance of the carrier, the degree of the exposure of the carrier core material is enhanced; therefore, the effects of the invention are not produced; that is the cracking and chipping are not suppressed. When the conductive particles are not contained, the charges generated on the surface of the carrier are accumulated particularly in a low-temperature and low-humidity condition, so that developing property is deteriorated by charge-up and toner particles having small diameters tend to adhere to the surface of the carrier, thereby increasing the toner component.

In the carrier of the invention, the electric resistance of the carrier is controlled by the amount of the conductive particles in the resin coated film. Therefore, the resistance of the carrier can be controlled while the entire surface of the core material is covered. Accordingly, the carrier adherence does not occur in a high-temperature and high-humidity condition. Also, even in a low-temperature and low-humidity condition, the charges generated on the surface of the carrier easily leak owing to the presence of the conductive particles on the surface of the carrier. As the result, deterioration in image quality caused by charge-up and the sticking of highly charged toner particles can be suppressed. For the reasons described above, the presence of the conductive particles in the resin coating layer enables formation of images with high quality.

In order to produce the effects of the invention, the volume resistance of the carrier is preferably set at a value within the range of $1\times10^{9}\Omega\cdot$cm to $5\times10^{16}\Omega\cdot$cm. The carrier of the invention enables the formation of images with high quality for a long period of time because separate controls of the carrier shape maintaining property (e.g., suppression of cracking and chipping of the carrier) and the electric resistance of the carrier are possible.

The volume average particle diameter of the conductive particles is preferably in the range of 25 to 60 μm and more preferably in the range of 30 to 50 μm. When the volume average particle diameter of the conductive particles is less than 25 μm, the fluidity is likely to be reduced to deteriorate the toner spent; therefore, it is sometimes difficult to maintain the electrification properties of the carrier stably. Also, because the magnetic force of the carrier per particle is reduced, the magnetic restraint of the chain on the magnetic brush is weaker than the developing electric field and the carrier is likely to adhere to the photoreceptor. When the volume average particle diameter exceeds 60 μm, on the other hand, the resin coating layer is easily peeled off by increased collision energy and stress in a developing machine, and the electrification properties and resistance of the carrier are likely to be deteriorated.

The conductive particles have a saturation magnetization at 3000 oersteds of preferably 50 emu/g or more, and more preferably 60 emu/g or more. When the saturation magnetization is lower than 50 emu/g, the magnetic restraint of the chain on the magnetic brush is weaker than the developing electric field, whereby the carrier is likely to adhere to the photoreceptor.

Specific examples of the above conductive particles include metal powder, carbon black, titanium oxide, tin oxide and zinc oxide. Among these materials, metal powder, carbon black and titanium oxide are preferable.

These conductive powders each preferably have an average particle diameter of 1 μm or less. When the above average particle diameter exceeds 1 μm, the dispersion state of the conductive particles in the resin coating layer is likely to be deteriorated; therefore, it is difficult to control electric resistance and the resin coating layer is likely to be weak, so that it may be difficult to maintain the electric resistance properties and electrification properties of the carrier. Also, the conductivity of the conductive powder itself is preferably $10^{10}\Omega\cdot$cm or less and more preferably $10^{9}\Omega\cdot$cm or less. Further, plural conductive resins or the like may be used together as necessary.

The content of the above conductive particles in the resin coating layer is preferably 3 to 40% by weight and more preferably 5 to 35% by weight. When the content is 3% by weight or more, the electric resistance of the carrier is maintained low and increase in charge quantity under a low-temperature and low-humidity condition can be suppressed. Moreover, when the content is 40% by weight or less, reduction in charge quantity under a high-temperature and high-humidity condition can be suppressed.

Other Additives

Also, the resin coating layer of the above carrier may contain resin particles (e.g., thermoplastic resins and thermosetting resins) for the purpose of charge control.

Specific examples of the thermoplastic resins include: polyolefin-based resins (e.g., polyethylene and polypropylene); polyvinyl-based resins and polyvinylidene-based resins (e.g., polystyrene, acryl resin, polyacrylonitrile, polyvinyl acetate, polyvinyl alcohol, polyvinylbutyral, polyvinyl chloride, polyvinylcarbazole, polyvinyl ether and polyvinyl ketone); vinyl chloride-vinyl acetate copolymers; styrene-acrylic acid copolymers; straight silicon resins comprising organosiloxane bonds, and modified products thereof; fluororesins (e.g., polytetrafluoroethylene, polyvinyl fluoride, polyvinylidene fluoride and polychlorotrifluoroethylene); polyesters; and polycarbonates.

Examples of the thermosetting resins include: phenol resins; amino resins (e.g., a urea-formaldehyde resin, melamine resin, benzoguanamine resin, urea resin and polyamide resin); and epoxy resins.

The volume average particle diameter of the above resin particles is preferably 0.1 to 1.5 μm. When the particle diameter is less than 0.1 μm, the dispersibility is so poor as to form aggregates in the resin coating layer, and the degree of the exposure of the carrier surface is unstable. Therefore it may be difficult to maintain stable electrification properties, and the strength of the resin coating layer is likely to be decreased at the boundary of the aggregates to make the resin coating layer vulnerable to cracking. When the particle diameter exceeds 1.5 μm, the resin particles easily dissociate from the resin coating layer, and the charge imparting function cannot be exhibited depending on cases.

The content of the resin particles in the resin coating layer is preferably 2 to 20% by weight, and more preferably 5 to 15% by weight. When the content is less than 2% by weight, the charging stability and charge retention property are likely to be insufficient. When the content exceeds 20% by weight, the strength of the resin coating layer is reduced and the resin coating layer is likely to be vulnerable to cracking.

(Formation of Resin Coating Layer)

The resin coating layer may be formed on the surface of the carrier core, using a resin coating layer forming liquid containing, in a solvent, the resin, the conductive powder, and optionally the resin particles and the like. Exemplary methods include: a dipping method of dipping the carrier core material in the resin coating layer forming liquid; a spraying method of spraying the resin coating layer forming liquid onto the surface of the carrier core material; a fluidized bed method of spraying the resin coating layer forming liquid onto the carrier core material while the carrier core material is floated by the flowing air; and a kneader coater method of dispersing the carrier core material in the resin coating layer forming liquid in a kneader coater, followed by removal of the solvent. The method of forming the resin coating layer in the invention is not limited to these methods using a solution. For example, a powder coating method of mixing the carrier core material with a resin powder under heating may be used depending on the type of carrier core material.

The solvent of the raw material solution for forming the resin coating layer is not particularly limited insofar as it dissolves the resin. Examples of the solvent include: aromatic hydrocarbons such as xylene and toluene; ketones such as acetone and methyl ethyl ketone; ethers such as tetrahydrofuran and dioxane; and halides such as chloroform and carbon tetrachloride.

(Toner)

Next, the toner particles used in the electrostatic latent image developer of the invention will be explained.

The toner particles to be used in the invention may be selected from known toner particles. For example, various toners produced by the following methods are usable: a kneading milling method comprising kneading a binder resin, a colorant, optionally a releasing agent, optionally a charge control agent, and the like, and milling and classifying the mixture; a method comprising modifying, by mechanical impact or heat energy, the shape of the particles obtained by the kneading milling method; an emulsion polymerization aggregation method comprising emulsion-polymerize a polymerizable monomer of a binder resin, mixing the obtained dispersion liquid, a colorant, and optionally dispersion liquid(s) of a releasing agent, a charge control agent, and the like, and aggregating and fusing the mixture under heating to obtain toner particles; a suspension polymerization method comprising suspending, in an aqueous solvent, a solution containing a polymerizable monomer for forming a binder resin, a colorant, and optionally solution(s) of a releasing agent, a charge control agent, and the like, and conducting polymerization; and a dissolution suspension method comprising suspending, in an aqueous solvent, a solution containing a polymerizable monomer for forming a binder resin, a colorant, and optionally solutions of a releasing agent, a charge control agent, and the like, so as to form particles. Aggregated particles may be adhered to the toners (as cores) obtained by the above methods, and then heated and fused to form core-shell structures. The suspension polymerization method, emulsion polymerization coagulation method, and dissolution suspension method, each involving the formation of toner particles in an aqueous solvent, are preferable from the viewpoints of shape control and control of particle size distribution. The emulsion polymerization aggregation method is particularly preferable.

The toner particles comprise a binder resin and a colorant and optionally comprise a releasing agent, silica, a charge control agent and the like as necessary. The volume average average particle diameter of the toner particles is preferably 2 to 12 μm, and more preferably 3 to 9 μm.

Examples of the binder resin to be used include homopolymers or copolymers of styrenes such as styrene and chlorostyrene, mono-olefins such as ethylene, propylene, butylene and isoprene, vinyl esters such as vinyl acetate, vinyl propionate, vinyl benzoate and vinyl butyrate, α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate, vinyl ethers such as vinyl methyl ether, vinyl ethyl ether and vinyl butyl ether, and vinyl ketones such as vinyl methyl ketone, vinyl hexyl ketone and vinyl isopropenyl ketone. Typical examples thereof include polystyrene, styrene-alkyl acrylate copolymers, styrene-alkyl methacrylate copolymers, styrene-acrylonitrile copolymers, styrene-butadiene copolymers, styrene-maleic acid anhydride copolymers, polyethylene, and polypropylene. Further, polyesters, polyurethane, epoxy resins, silicone resins, polyamide, modified rosin and paraffin wax are also usable.

Typical examples of the colorant include magnetic powders such as magnetite and ferrite, carbon black, Aniline Blue, Chalcoyl Blue, Chrome Yellow, Ultramarine Blue, Du Pont Oil Red, Quinoline Yellow, Methylene Blue Chloride, Phthalocyanine Blue, Malachite Green Oxalate, Lamp Black, Rose Bengal, C.I. Pigment Red 48:1, C.I. Pigment Red 122, C.I. Pigment Red 57:1, C.I. Pigment Yellow 97, C.I. Pigment Yellow 17, C.I. Pigment Blue 15:1 and C.I. Pigment Blue 15:3.

Examples of the releasing agent include a low-molecular polyethylene, low-molecular polypropylene, Fisher-Tropsch wax, montan wax, carnauba wax, rice wax and candelilla wax.

The toner particles may further comprise a charge control agent as necessary. The charge control agent may be a known compound, and examples thereof include azo-based metal complex compounds, metal complex compounds of salicylic acid, and resin-based charge control agents containing a polar group. When the toner is produced by a wet process, it is preferable to use materials that are scarcely soluble in water, from the viewpoint of controlling ionic strength and reducing pollution caused by waste liquid. The toner particles in the invention may be either magnetic toner particles containing magnetic materials or non-magnetic toner particles containing no magnetic material.

In the invention, particles may be added externally to the above toner particles (toner mother particles) for various purposes. It is preferable to add a large-sized inorganic oxide having a volume average particle diameter of 20 to 300 nm in view of the reduction of adhesion and the control of charge. Examples of the large-sized inorganic oxide particles include particles of silica, titanium oxide, methatitanic acid, aluminum oxide, magnesium oxide, alumina, barium titanate, magnesium titanate, calcium titanate, strontium titanate, zinc oxide, chrome oxide, antimony trioxide, magnesium oxide, and zirconium oxide.

The toner used in the invention may be produced by mixing the toner particles with the external additives by using a Henshel mixer, a V-blender, or the like. When the toner particles are produced by a wet method, the external additives may be added according to a wet method. Throughout the specification, the terms "particle diameter" and "average particle diameter" refer to a volume average particle diameter unless otherwise specified.

EXAMPLES

The present invention will be explained in more detail by reference to Examples. However, Examples should not be construed as limiting the invention. In the following, expressions "parts" and "%" indicate "parts by weight" and "weight percentage (wt. %)", respectively, unless otherwise mentioned.

First, methods for measuring each characteristic value of the toner, carrier and developer in Examples and Comparative examples will be explained.

The BET specific surface area and internal void ratio of the core particles, and the average particle diameter and average degree of circularity of the carrier are measured according to the aforementioned methods. Also, the average particle diameter and average degree of circularity of the core particles are measured in the same manner as the measurement of the average particle diameter and average degree of circularity of the carrier.

Measurement of Shape Factor SF1 of Toner (Particles)

The toner shape factor SF1 is obtained as described below. Optical microscope images of toner particles sprayed onto a slide glass are inputted into a Luzex image analyzer through a video camera. The maximum length and projected area of each of 50 or more particles are measured, and the SF1 value of each particle is calculated according to the following equation:

$$SF1=(ML^2/A)\times(\pi/4)\times 100$$

wherein ML represents the absolute maximum length of the toner particle and A represents the projected area of the toner particle.

Then, the average value of the SF1 values of the 50 or more particles is calculated to give the toner shape factor SF1.

If the shape factor SF1 exceeds 140, the shape of the toner is close to an amorphous shape, so that the fluidity and transferability is not improved sufficiently. Accordingly, toner having a shape factor SF1 of more than 140 is not preferable.

Measurement of Average Particle Diameter of Toner

When the diameter of the particle to be measured is 2 μm or more, the diameter is measured by a measuring device (trade name: MULTISIZER II-model, manufactured by Beckman-Coulter) using an electrolytic solution (trade name: ISOTON-II, manufactured by Beckman Coulter).

The measuring method is as follows: 0.5 to 50 mg of the test sample is added to 2 ml of aqueous 5% solution of a surfactant as a dispersant (preferably sodium alkylbenzenesulfonate). The solution is added to 100 ml of the above electrolytic solution. The electrolytic solution containing the test sample suspended therein is subjected to a dispersing treatment by a ultrasonic dispersing machine for 1 minute. Then, the diameter distribution of the particles having particle diameters within the range of 2.0 to 60 μm is measured by the aforementioned MULTISIZER II-model with an aperture having an aperture diameter of 100 μm. The number of particles to be measured is 50,000.

Based on the measured number of particles within each of the divided particle diameter ranges (channels), cumulative distribution curves with respect to the volume and number are plotted against particle diameter. The particle diameter corresponding to the point on the cumulative volume curve at which the cumulative volume reaches 50% of the total volume is defined as volume average particle diameter D50v, and used as the average particle diameter.

(Preparation of Ferrite Particles C1)

73 parts of $Fe_2O_3$, 23 parts of $MnO_2$, and 4 parts of $Mg(OH)_2$ are mixed, and then further mixed and milled by a wet type ball mill. Thereafter, the mixture is granulated and dried by a spray drier, and then baked at 900° C. for 10 hours using a rotary kiln. Then, the baked granular material is subjected to a crushing step and a classifying step to prepare Mn—Mg ferrite particles C1 (core particles) having a particle diameter of 36.0 μm.

(Preparation of Ferrite Particles C2)

Ferrite particles C2 having a particle diameter of 34.1 μm are prepared in the same manner as the preparation of ferrite particles C1 except that the raw materials are mixed and milled by a ball mill for 9 hours.

(Preparation of Ferrite Particles C3)

Ferrite particles C3 having a particle diameter of 40.2 μm are prepared in the same manner as the preparation of ferrite particles C1 except that the raw materials are mixed and milled by a ball mill for 5 hours.

(Preparation of Ferrite Particles C4)

Ferrite particles C4 having a particle diameter of 31.2 μm are prepared in the same manner as the preparation of ferrite particles C1 except that the baking condition is changed to baking at 900° C. for 7 hours.

(Preparation of Ferrite Particles C5)

Ferrite particles C5 having a particle diameter of 31.1 μm are prepared in the same manner as the preparation of ferrite particles C1 except that the baking condition is changed to baking at 800° C. for 7 hours.

(Preparation of Ferrite Particles C6)

Ferrite particles C6 having a particle diameter of 42.3 μm are prepared in the same manner as the preparation of ferrite particles C1 except that the baking condition is changed to baking at 1200° C. for 7 hours.

(Preparation of Ferrite Particles C7)

Ferrite particles C7 having a particle diameter of 45.9 μm are prepared in the same manner as the preparation of ferrite particles C1 except that the baking condition is changed to baking at 1300° C. for 8 hours.

(Preparation of Ferrite Particles C8)

Ferrite particles C8 having a particle diameter of 39.4 μm are prepared in the same manner as the preparation of ferrite particles C1 except that the baking condition is changed to baking at 1200° C. for 5 hours.

(Preparation of Ferrite Particles C9)

Ferrite particles C9 having a particle diameter of 38.8 μm are prepared in the same manner as the preparation of ferrite particles C1 except that the baking condition is changed to baking at 1300° C. for 4 hours.

(Preparation of Ferrite Particles C10)

Ferrite particles C10 are prepared in the same manner as the preparation of ferrite particles C1 except that the particle diameter of the ferrite particles is changed to 52.0 μm by classification (sieving).

(Preparation of Ferrite Particles C11)

Ferrite particles C11 are prepared in the same manner as the preparation of ferrite particles C1 except that the particle diameter of the ferrite particles is changed to 62.8 μm by classification (sieving).

(Preparation of Ferrite Particles C12)

Ferrite particles C12 are prepared in the same manner as the preparation of ferrite particles C1 except that the particle diameter of the ferrite particles is changed to 29.4 μm by classification (sieving).

(Preparation of Ferrite Particles C13)

Ferrite particles C13 are prepared in the same manner as the preparation of C1 except that the particle diameter of the ferrite particles is changed to 22.1 μm by classification (sieving).

The characteristic values of the ferrite particles C1 to C13 obtained above are shown in Table 1.

TABLE 1

| Ferrite particles | Particle diameter (μm) | Average degree of circularity | BET specific surface area ($m^2/g$) | Internal void ratio (%) |
|---|---|---|---|---|
| C1 | 36.0 | 0.992 | 0.2211 | 0.8 |
| C2 | 34.1 | 0.979 | 0.2374 | 1.5 |
| C3 | 40.2 | 0.971 | 0.2411 | 3.5 |
| C4 | 31.2 | 0.986 | 0.2837 | 4.2 |
| C5 | 31.1 | 0.977 | 0.3113 | 8.6 |
| C6 | 42.3 | 0.993 | 0.1268 | 0.2 |
| C7 | 45.9 | 0.987 | 0.0973 | 0.3 |
| C8 | 39.4 | 0.986 | 0.2841 | 9.2 |
| C9 | 38.8 | 0.989 | 0.2815 | 12.1 |
| C10 | 52.0 | 0.991 | 0.1028 | 2.0 |
| C11 | 62.8 | 0.978 | 0.1017 | 2.2 |
| C12 | 29.4 | 0.993 | 0.2876 | 0.8 |
| C13 | 22.1 | 0.984 | 0.2914 | 0.4 |

(Preparation of Carrier 1)

| | |
|---|---|
| Mn—Mg ferrite particles C1 | 100 parts |
| Coating layer forming liquid 1 | |
| Toluene | 40 parts |
| Styrene-methyl methacrylate copolymer (in a ratio by weight of 60:40, weight average molecular weight: 80000) | 2.8 parts |
| Carbon black (trade name: REGAL330, manufactured by Cabot) | 0.2 part |

The above components except for the ferrite particles are mixed, and the mixture is subjected to stirring and dispersing treatment by a stirrer for 60 minutes to prepare a coating layer forming liquid 1. Further, the coating layer forming liquid 1 and the ferrite particles are put in a vacuum type kneader (trade name: KHO-5, manufactured by Inoue Seisakusho), and stirred at 60° C. for 20 minutes. Then, the mixture is deaerated under heating to be dried under reduced pressure. Then, the resulting particles are allowed to pass through a 75 μm-mesh screen to give carrier 1.

(Preparation of Carrier 2)

Carrier 2 is produced in the same manner as the preparation of carrier 1 except that Mn—Mg ferrite particles C2 are used in place of Mn—Mg ferrite particles C1.

(Preparation of Carrier 3)

Carrier 3 is produced in the same manner as the preparation of carrier 1 except that Mn—Mg ferrite particles C3 are used in place of Mn—Mg ferrite particles C1.

(Preparation of Carrier 4)

Carrier 4 is produced in the same manner as the preparation of carrier 1 except that Mn—Mg ferrite particles C4 are used in place of Mn—Mg ferrite particles C1.

(Preparation of Carrier 5)

Carrier 5 is produced in the same manner as the preparation of carrier 1 except that Mn—Mg ferrite particles C5 are used in place of Mn—Mg ferrite particles C1.

(Preparation of Carrier 6)

| | |
|---|---|
| Mn—Mg ferrite particles C6 | 100 parts |
| Coating layer forming liquid 2 | |
| Toluene | 40 parts |
| Styrene-methacrylate copolymer (in a ratio by weight of 80:20, weight average molecular weight: 76000) | 2.1 parts |
| Carbon black (trade name: REGAL330, manufactured by Cabot) | 0.15 part |

The above components except the ferrite particles are mixed, and subjected to a stirring and dispersing treatment by a stirrer for 60 minutes to prepare a coating layer forming liquid 2. The coating layer forming liquid 2 and the ferrite particles are put in a vacuum deaerating type kneader, and stirred at 60° C. for 20 minutes. Then, the mixture is deaerated under heating to be dried under reduced pressure. Then, the resulting particles are allowed to pass through a 75 μm-mesh screen to give carrier 6.

(Preparation of Carrier 7)

Carrier 7 is produced in the same manner as the preparation of carrier 6 except that Mn—Mg ferrite particles C7 are used in place of Mn—Mg ferrite particles C6.

(Preparation of Carrier 8)

Carrier 8 is produced in the same manner as the preparation of carrier 6 except that Mn—Mg ferrite particles C8 are used in place of Mn—Mg ferrite particles C6.

(Preparation of Carrier 9)

Carrier 9 is produced in the same manner as the preparation of carrier 6 except that Mn—Mg ferrite particles C9 are used in place of Mn—Mg ferrite particles C6.

(Preparation of Carrier 10)

| | |
|---|---|
| Mn—Mg ferrite particles C10 | 100 parts |
| Coating layer forming liquid 3 | |
| Toluene | 40 parts |
| Styrene-methyl methacrylate copolymer (in the ratio by weight of 80:20, weight average molecular weight: 76000) | 1.8 parts |
| Carbon black (trade name: REGAL330, manufactured by Cabot) | 0.13 part |

The above components except for the ferrite particles are mixed, and subjected to a stirring and dispersing treatment by a stirrer for 60 minutes to prepare a coating layer forming liquid 3. The coating layer forming liquid 3 and the ferrite particles are put in a vacuum deaerating type kneader, and stirred at 60° C. for 20 minutes. Then, the mixture is deaerated under heating to be dried under reduced pressure. Then, the resulting particles are allowed to pass through a 75 μm-mesh screen to give carrier 10.

(Preparation of Carrier 11)

Carrier 11 is produced in the same manner as the preparation of carrier 10 except that Mn—Mg ferrite particles C11 are used in place of Mn—Mg ferrite particles C10.

(Preparation of Carrier 12)

| | |
|---|---|
| Mn—Mg ferrite particles C12 | 100 parts |
| Coating layer forming liquid 4 | |
| Toluene | 40 parts |
| Styrene-methyl methacrylate copolymer (in the ratio by weight of 80:20, weight average molecular weight: 76000) | 2.8 parts |
| Carbon black (trade name: REGAL330, manufactured by Cabot) | 0.22 parts |

The above components except the ferrite particles are mixed, and subjected to a stirring and dispersing treatment by a stirrer for 60 minutes to prepare a coating layer forming liquid 4. The coating layer forming liquid 4 and the ferrite particles are put in a vacuum deaerating type kneader, and stirred at 60° C. for 20 minutes. Then, the mixture is deaerated under heating to be dried under reduced pressure. Then, the resulting particles are allowed to pass through a 75 μm-mesh screen to give carrier 12.

(Preparation of Carrier 13)

Carrier 13 is produced in the same manner as the preparation of carrier 12 except that Mn—Mg ferrite particles C13 are used in place of Mn—Mg ferrite particles C12.

<Production of Toner Particles>

(Preparation of Resin Particle Dispersion Liquid)

| | |
|---|---|
| Styrene | 320 parts |
| n-Butyl acrylate | 80 parts |
| Acrylic acid | 8 parts |
| Dodecane thiol | 12 parts |

The above components are mixed to form a solution. The solution is added to another solution containing 6 parts of a nonionic surfactant (trade name: NONIPOLE 400, manufactured by Sanyo Chemical Industries, Ltd.) and 10 parts of an anionic surfactant (trade name: NEOGEN SC, manufactured by Dai-ichi Kogyo Seiyaku Co., Ltd.) dissolved in 550 parts of ion exchange water in a flask, so as to initiate emulsion polymerization. A solution containing 4 parts of ammonium persulfate dissolved in 50 parts of ion exchange water is added thereto over 10 minutes while the liquid is stirred slowly. The atmosphere in the flask is replaced with nitrogen, and then the content in the flask is heated under stirring in an oil bath until the temperature reaches 70° C. At that temperature, emulsion polymerization is continued for 5 hours. As a result, a resin particle dispersion liquid is obtained which contains dispersed resin particles having an average particle diameter of 150 nm, a Tg of 58° C., and a weight average molecular weight Mw of 29000.

(Preparation of Colorant Dispersion Liquid)

| | |
|---|---|
| Phthalocyanine pigment (trade name: PV FAST BLUE, manufactured by Dainichiseika Color & Chemicals Mfg. Co., Ltd.) | 60 parts |
| Nonionic surfactant (trade name: NONIPOLE 400, manufactured by Sanyo Chemical Industries, Ltd.) | 7 parts |
| Ion exchange water | 240 parts |

The above components are mixed to form a solution, and then stirred by a homogenizer (trade name: ULTRATURRAX T50, manufactured by IKA) for 10 minutes. Thereafter, the mixture is subjected to a dispersing treatment using an Altimizer to give a colorant dispersion containing colorant particles having a volume average particle diameter of 240 nm dispersed therein.

(Preparation of Releasing Agent Dispersion Liquid)

| | |
|---|---|
| Paraffin wax (trade name: HNP 0190, manufactured by Nippon Seiro Co., Ltd., melting point: 85° C.) | 100 parts |
| Cationic surfactant (trade name: SANISOL B50, manufactured by Kao Corporation) | 5 parts |
| Ion exchange water | 250 parts |

The above components are dispersed in a round type stainless steel flask by using a homogenizer (trade name: ULTRATURRAX T50, manufactured by IKA) for 10 minutes, and the mixture is then subjected to a dispersing treatment using a pressure discharge type homogenizer to give a releasing agent dispersion liquid containing releasing agent particles having an average particle diameter of 500 nm dispersed therein.

(Preparation of Toner Particles)

| | |
|---|---|
| The resin particle dispersion liquid | 234 parts |
| The colorant dispersion liquid | 30 parts |
| The releasing agent dispersion liquid | 40 parts |
| Aluminum polyhydroxide (trade name: PAHO 2S, manufactured by Asada Kagaku) | 0.5 parts |
| Ion exchange water | 600 parts |

The above components are mixed and put in a round type stainless steel flask, and subjected to a mixing and dispersing treatment by a homogenizer (trade name: ULTRATURRAX T50, manufactured by IKA). The mixture in the flask is then heated to 50° C. under stirring in a heating oil bath. After the mixture is maintained at 50° C. for 30 minutes, the formation of aggregated particles having a volume average particle diameter (D50) of 4.9 μm is confirmed. The temperature of the heating oil bath is further increased to 56° C., and the temperature of the dispersion liquid is maintained at 56° C. for 1 hour. As a result, the average particle diameter (D50) of the particles is increased to 5.9 μm. Then, 24 parts of the resin particle dispersion liquid is added to this dispersion liquid containing the aggregated particles. The temperature of the heating oil bath is changed to 50° C., and the temperature of the dispersion liquid is maintained at that temperature for 30 minutes. The dispersion liquid containing the aggregated particles is adjusted to pH 7.0 by the addition of 1N sodium hydroxide, and then the stainless flask is hermetically sealed. The dispersion liquid is heated to 80° C. under continuous stirring by a magnetic seal, and left at that temperature for 4 hours. After the resulting dispersion liquid is cooled, the toner mother particles are separated by filtration, washed with ion exchange water five times, and freeze-dried to obtain toner particles. The toner particles had a volume average particle diameter (D50) of 7.0 μm and a shape factor SF1 of 128.

(Production of Developer)

Using the toner particles and carriers 1 to 13 obtained above, thirteen developers are obtained. Specifically, the toner particles and each carrier are mixed in the ratio of 8/100 (toner:carrier=8:100) by using a V-blender at 20 rpm for a stirring time of 20 minutes, and then the mixture is sieved through a 125 μm screen to give a developer.

The results of measurement of the average particle diameter and average degree of circularity of each carrier are shown in Table 2.

(Evaluation)

Evaluation of Carrier Transfer

A 5 cm×5 cm solid image is printed by a modified machine of DOCU CENTER COLOR F450 (trade name, manufactured by Fuji Xerox Co., Ltd.) using each electrostatic latent image developer under a high-temperature and high-humidity circumstance (27° C. and 80% RH). The modified machine is capable of shutting down just after the printing of the solid image. During the above printing operation, the printing is stopped, and the image developed on the z optical body is transferred to a tape to count the number of carriers in the solid patch.

Next, after the above developing machine is operated with no load for 20 hours, the number of carriers in the solid patch is counted in the same manner as described above. The results of measurements and evaluations are shown in Table 2.

Carrier transfer is evaluated by the number of carrier particles in the solid patch and evaluated according to the following criteria:

A: 0 to 10 carrier particles (There is no image quality problem at all)

B: 11 to 25 carrier particles (White spots are confirmed by careful observation)

C: 26 or more carrier particles (Marked deterioration in image quality is observable)

TABLE 2

| | Carrier | | | Evaluation of carrier transfer | | | |
|---|---|---|---|---|---|---|---|
| | | | | Initial stage | | After operated with no load for 20 hours | |
| | Ferrite particles | Particle diameter (μm) | Average degree of circularity | Number of carriers | Evaluation | Number of carriers | Evaluation |
| Example 1 | C1 | 36.1 | 0.993 | 0 | A | 2 | A |
| Example 2 | C2 | 34.6 | 0.977 | 2 | A | 7 | A |
| Example 3 | C4 | 31.3 | 0.984 | 5 | A | 12 | B |
| Example 4 | C6 | 43.1 | 0.992 | 1 | A | 10 | A |
| Example 5 | C8 | 39.5 | 0.988 | 7 | A | 19 | B |
| Example 6 | C10 | 52.3 | 0.989 | 1 | A | 9 | A |
| Example 7 | C12 | 29.7 | 0.991 | 11 | B | 14 | B |
| Comp. Ex. 1 | C3 | 40.6 | 0.971 | 4 | A | 30 | C |
| Comp. Ex. 2 | C5 | 31.6 | 0.980 | 3 | A | 27 | C |
| Comp. Ex. 3 | C7 | 46.2 | 0.986 | 6 | A | 45 | C |
| Comp. Ex. 4 | C9 | 39.0 | 0.991 | 13 | B | 87 | C |
| Comp. Ex. 5 | C11 | 63.0 | 0.977 | 4 | A | 38 | C |
| Comp. Ex. 6 | C13 | 23.1 | 0.982 | 41 | C | 61 | C |

According to the invention, an electrostatic latent image developing carrier is provided. The transfer of the carrier is suppressed compared to conventional carriers. An electrostatic latent image developer is also provided which can form images with excellent half-tone image quality stably and which does not cause the transfer of the carrier.

What is claimed is:

1. An electrostatic latent image developing carrier comprising a core particle and a resin coating layer containing conductive particles dispersed therein, wherein the carrier has a volume average particle diameter of 25 to 60 μm and an average degree of circularity of 0.975 or more, the core particle has a BET specific surface area of 0.2211 to 0.3 $m^2/g$ and an internal void ratio of 10% or less, and the core particle contains $Fe_2O_3$ and an oxide(s) of one or more elements selected from Li, Mg, Ca, Mn, Ni, Cu, Zn and Sr.

2. The electrostatic latent image developing carrier according to claim 1, wherein a ratio of a content of the oxide(s) of one or more elements selected from Li, Mg, Ca, Mn, Ni, Cu, Zn and Sr to a content of $Fe_2O_3$ is 5 to 50% by weight.

3. The electrostatic latent image developing carrier according to claim 1, wherein the volume resistance of the electrostatic latent image developing carrier is $1\times10^9$ Ω·cm to $5\times10^{16}$ Ω·cm.

4. The electrostatic latent image developing carrier according to claim 1, wherein the conductive particles have a saturation magnetization at 3000 oersteds of 50 emu/g or more.

5. The electrostatic latent image developing carrier according to claim 1, wherein the conductive particles have a volume resistance of $10^{10}$ Ω·cm or less.

6. The electrostatic latent image developing carrier according to claim 1, wherein the resin coating layer comprises resin particles.

7. The electrostatic latent image developing carrier according to claim 6, wherein the resin particles are a thermosetting resin and/or a thermoplastic resin.

8. The electrostatic latent image developing carrier according to claim 6, wherein the resin particles have a volume average particle diameter of 0.1 to 1.5 μm.

9. The electrostatic latent image developing carrier according to claim 6, wherein a content of the resin particles in the resin coating layer is 2 to 20% by weight.

10. The electrostatic latent image developing carrier according to claim 1, wherein the internal void ratio of the core particle is 5% or less.

11. An electrostatic latent image developer comprising a toner and an electrostatic latent image developing carrier, wherein the electrostatic latent image developing carrier comprises a core particle and a resin coating layer containing conductive particles dispersed therein, the carrier has a volume average particle diameter of 25 to 60 μm and an average degree of circularity of 0.975 or more, the core particle has a BET specific surface area of 0.2211 to 0.3 $m^2/g$ and an internal void ratio of 10% or less, and the core particle contains $Fe_2O_3$ and an oxide(s) of one or more elements selected from Li, Mg, Ca, Mn, Ni, Cu, Zn and Sr.

12. The electrostatic latent image developer according to claim 11, wherein the toner has a volume average particle diameter of 2 to 12 μm.

13. The electrostatic latent image developer according to claim 11, wherein the toner comprises a releasing agent.

14. The electrostatic latent image developer according to claim 11, wherein the toner comprises an inorganic oxide having a volume average particle diameter of 20 to 300 nm.

15. The electrostatic latent image developer according to claim 11, wherein a shape factor SF1 of the toner is 140 or less.

16. The electrostatic latent image developing carrier according to claim 11, wherein the internal void ratio of the core particle is 5% or less.

* * * * *